US009303346B2

(12) United States Patent
Kobayashi et al.

(10) Patent No.: US 9,303,346 B2
(45) Date of Patent: Apr. 5, 2016

(54) EMBROIDERY FRAME AND SEWING MACHINE

(71) Applicant: BROTHER KOGYO KABUSHIKI KAISHA, Nagoya-shi, Aichi-ken (JP)

(72) Inventors: Harumi Kobayashi, Nagoya (JP); Katsuhisa Hasegawa, Kasugai (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 14/612,645

(22) Filed: Feb. 3, 2015

(65) Prior Publication Data

US 2015/0240401 A1 Aug. 27, 2015

(30) Foreign Application Priority Data

Feb. 25, 2014 (JP) ..... 2014-033522

(51) Int. Cl.

| | |
|---|---|
| ***D05C 9/04*** | (2006.01) |
| ***D05C 9/06*** | (2006.01) |
| ***D05C 7/08*** | (2006.01) |
| ***D05B 19/12*** | (2006.01) |
| ***D05B 35/06*** | (2006.01) |

(52) U.S. Cl.

CPC *D05C 9/04* (2013.01); *D05B 19/12* (2013.01); *D05B 35/06* (2013.01); *D05C 7/08* (2013.01); *D05C 9/06* (2013.01)

(58) Field of Classification Search

CPC ..... D05C 7/00; D05C 7/02; D05C 7/08; D05C 11/00; D05C 9/04; D05C 9/06; D05C 3/02; D04D 1/04; D05D 2303/08; D05B 3/12; D05B 3/243; D05B 53/00; D05B 39/00; D05B 19/12; D05B 19/16; D05B 35/06

See application file for complete search history.

(56) References Cited

U.S. PATENT DOCUMENTS

| | | | | | |
|---|---|---|---|---|---|
| 226,206 | A | * | 4/1880 | Schlueter | D05C 7/08 112/101 |
| 797,308 | A | * | 8/1905 | Nassberg | D04D 1/04 112/102 |
| 2,137,454 | A | * | 11/1938 | Litsey | D05C 7/08 112/101 |
| 2,725,837 | A | * | 12/1955 | Seaman | D05C 7/08 112/101 |
| 3,082,721 | A | * | 3/1963 | Bono | D05B 27/24 112/102 |

(Continued)

FOREIGN PATENT DOCUMENTS

| | | | |
|---|---|---|---|
| DE | 102011122422 | A1 * | 6/2013 |
| JP | 2002-052283 | A | 2/2002 |

(Continued)

*Primary Examiner* — Ismael Izaguirre

(74) *Attorney, Agent, or Firm* — Oliff PLC

(57) ABSTRACT

An embroidery frame includes a mounting portion, an annular portion, a rotation member, a first guide portion, an extending portion, and a drive mechanism. The mounting portion is mounted on a carriage of a sewing machine. The annular portion holds a work cloth. The rotation member is formed in an annular shape and is supported by the annular portion. The rotation member rotates in a circumference direction of the annular portion. The first guide portion is provided on the rotation member and has a first penetrating portion. A through hole is formed in the first penetrating portion. A string-like material to be supplied for sewing is inserted through the first penetrating portion. The extending portion is formed on the annular portion and extends toward the outside in a radial direction of the annular portion. The drive mechanism is provided on the extending portion and rotates the rotation member.

9 Claims, 15 Drawing Sheets

(56) References Cited

U.S. PATENT DOCUMENTS

| | | | | |
|---|---|---|---|---|
| 3,855,955 | A * | 12/1974 | Strang | D05B 39/00 112/152 |
| 6,957,615 | B1 * | 10/2005 | Landoni | D05C 7/08 112/117 |
| 2006/0180066 | A1 * | 8/2006 | Okazaki | D05C 9/04 112/258 |
| 2013/0074748 | A1 | 3/2013 | Kato et al. | |
| 2014/0144360 | A1 * | 5/2014 | Magara | D05B 69/12 112/470.18 |

FOREIGN PATENT DOCUMENTS

| | | | |
|---|---|---|---|
| JP | 2007-014674 | A | 1/2007 |
| JP | 2013-070875 | A | 4/2013 |

* cited by examiner

FIG. 7

80

| NUMBER OF STITCHES | X COORDINATE | Y COORDINATE | ROTATION ANGLE |
|---|---|---|---|
| 1 | 1 | -1 | 265 DEGREES |
| 2 | 0 | -1 | 265 DEGREES |
| 3 | -1 | -1 | 265 DEGREES |
| 4 | -2 | -1 | 265 DEGREES |
| 5 | -3 | -1 | 265 DEGREES |
| 6 | -4 | -1 | 265 DEGREES |
| 7 | -5 | -1 | 265 DEGREES |
| 8 | -5 | 0 | 333 DEGREES |
| 9 | -5 | 1 | 333 DEGREES |
| 10 | -5 | 2 | 333 DEGREES |
| 11 | -5 | 3 | 333 DEGREES |
| 12 | -4 | 3 | 75 DEGREES |
| 13 | -3 | 3 | 75 DEGREES |
| 14 | -2 | 3 | 75 DEGREES |
| 15 | -1 | 3 | 75 DEGREES |
| 16 | 0 | 3 | 75 DEGREES |
| 17 | 1 | 3 | 75 DEGREES |
| 18 | 1 | 2 | 175 DEGREES |
| 19 | 1 | 1 | 175 DEGREES |
| 20 | 1 | 0 | 175 DEGREES |
| 21 | 1 | -1 | 175 DEGREES |

EMBROIDERY FRAME AND SEWING MACHINE

CROSS-REFERENCE TO RELATED APPLICATION

This Application claims priority to Japanese Patent Application No. 2014-033522, filed on Feb. 25, 2014, the content of which is hereby incorporated by reference.

BACKGROUND

The present disclosure relates to an embroidery frame that is mounted on a transport device of a sewing machine, and to a sewing machine that is provided with the embroidery frame.

In related art, an embroidery sewing machine is known that can sew a string-like material onto a work cloth. Wool, a cord, a tape and the like are used as the string-like material. For example, the above-described sewing machine is an embroidery sewing machine that is capable of embroidery sewing, and is provided with a rotation mechanism. The rotation mechanism causes a bobbin, around which is wound the string-like material such as the cord, tape or the like, to rotate centering on a needle bar. The rotation mechanism is driven by a bobbin rotating motor. The sewing machine uses the bobbin rotating motor to rotate the bobbin such that a position of the bobbin is changed, and performs control such that the direction in which the string-like material is supplied is aligned with the direction in which stitches are to be formed.

SUMMARY

Note that the rotation mechanism of the above-described sewing machine is a special mechanism to automatically perform embroidery sewing of the string-like material. Currently, there are sewing machines that are capable of embroidery sewing even among domestic sewing machines that are used in homes by general users. However, it is structurally difficult to provide the above-described rotation mechanism in a domestic sewing machine. Therefore, in order to perform embroidery sewing in which the string-like material is sewn using a domestic sewing machine, a user needs to manually align the direction in which the string-like material is supplied with the direction in which stitches are to be formed.

It is an object of the present disclosure to provide an embroidery frame that makes it possible to automatically perform embroidery sewing to sew a string-like material, particularly in a domestic sewing machine, and a sewing machine that is provided with the embroidery frame.

Exemplary embodiments provide an embroidery frame that includes a mounting portion, an annular portion, a rotation member, a first guide portion, an extending portion, and a drive mechanism. The mounting portion can be mounted on a carriage of a transport device of a sewing machine. The annular portion is formed in an annular shape and is configured to hold a work cloth. The rotation member is formed in an annular shape and is supported by the annular portion. The rotation member can rotate in a circumference direction of the annular portion. The first guide portion is provided on the rotation member and has a first penetrating portion. A through hole is formed in the first penetrating portion. A string-like material to be supplied for sewing is inserted through the first penetrating portion. The extending portion is formed on the annular portion and extends toward the outside in a radial direction of the annular portion. The drive mechanism is provided on the extending portion and rotates the rotation member.

Exemplary embodiments also provide a sewing machine that includes a transport device, a memory, and a control device. The transport device moves an embroidery frame mounted thereon. The embroidery frame includes a mounting portion, an annular portion, a rotation member, a first guide portion, an extending portion, and a drive mechanism. The mounting portion can be mounted on a carriage of the transport device of the sewing machine. The annular portion is formed in an annular shape and is configured to hold a work cloth. The rotation member is formed in an annular shape and is supported by the annular portion. The rotation member can rotate in a circumference direction of the annular portion. The first guide portion is provided on the rotation member and has a first penetrating portion. A through hole is formed in the first penetrating portion. A string-like material to be supplied for sewing is inserted through the first penetrating portion. The extending portion is formed on the annular portion and extends toward the outside in a radial direction of the annular portion. The drive mechanism is provided on the extending portion and rotates the rotation member. The memory stores sewing data to sew the string-like material, the sewing data including movement data that causes the embroidery frame to move for each stitch, and rotation data that causes the rotation member to rotate. The control device acquires the sewing data, and that controls the transport device and the drive mechanism based on the acquired sewing data.

BRIEF DESCRIPTION OF THE DRAWINGS

Embodiments will be described below in detail with reference to the accompanying drawings in which:

FIG. 7 is a data configuration diagram of embroidery data 80;

DETAILED DESCRIPTION

Hereinafter, an embodiment of the present disclosure will be explained with reference to the drawings. Note that the drawings are used to explain technical features that the present disclosure can adopt, and the drawings are not intended to limit the content. A physical configuration of a sewing machine 1 will be explained with reference to FIG. 1.

Figure 1:
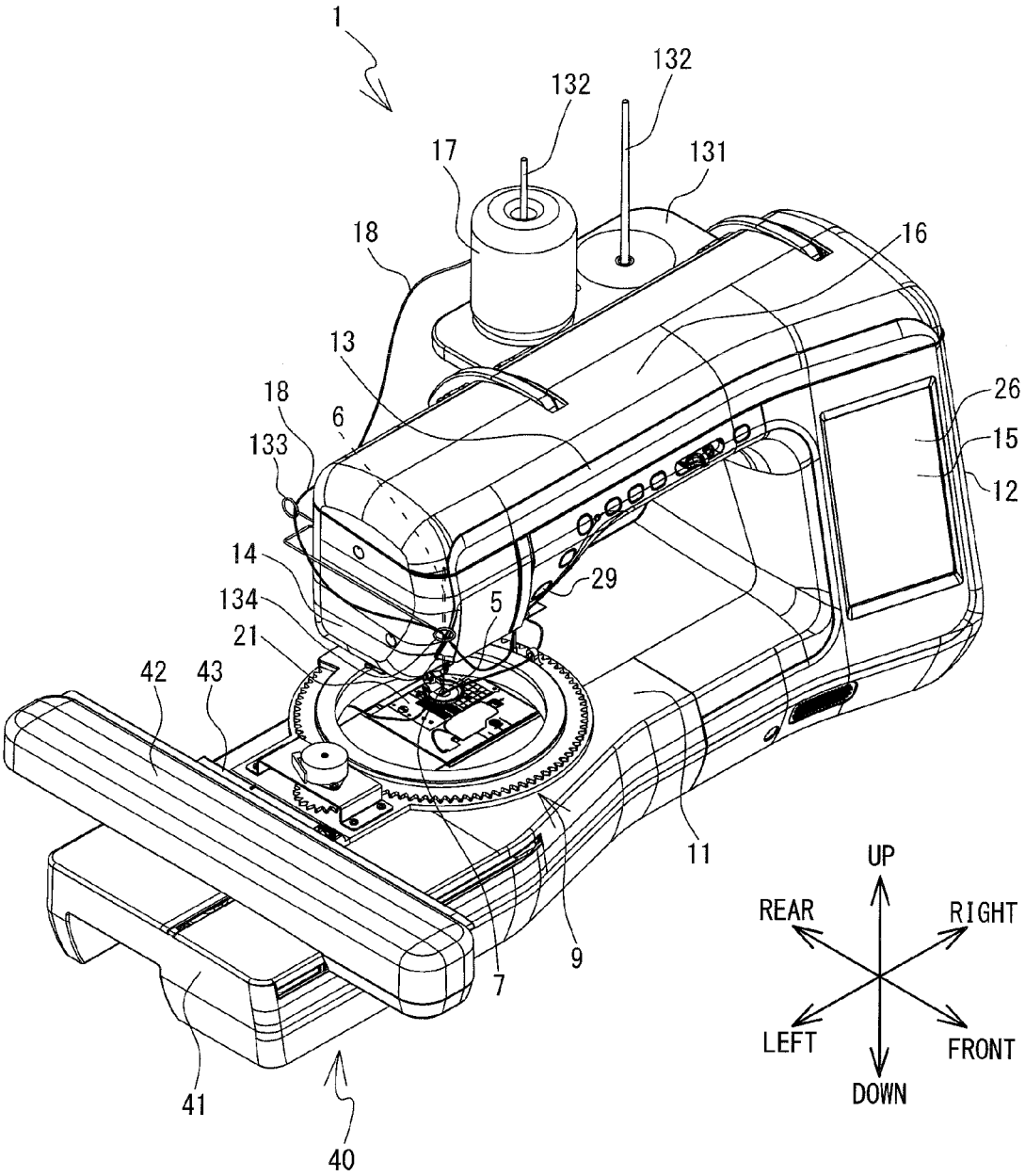
FIG. 1 is a perspective view of a sewing machine 1.

The up-down direction, the lower right side, the upper left side, the lower left side and the upper right side in FIG. 1 are respectively the up-down direction, the front, the rear, the left and the right of the sewing machine 1. In other words, the surface on which a liquid crystal display 15 (which will be described later) is disposed is the front surface of the sewing machine 1. The long side direction of a bed portion 11 and an arm portion 13 is the left-right direction of the sewing machine 1, and the side on which a pillar 12 is disposed is the right side. The extending direction of the pillar 12 is the up-down direction of the sewing machine 1.

As shown in FIG. 1, the sewing machine 1 is a domestic sewing machine that is provided with the bed portion 11, the pillar 12, the arm portion 13 and a head portion 14. The bed portion 11 is a base portion of the sewing machine 1 and extends in the left-right direction. The pillar 12 extends upward from a right end portion of the bed portion 11. The arm portion 13 extends to the left from the upper end of the pillar 12 such that the arm portion 13 faces the bed portion 11. The head portion 14 is a portion that is connected to a left end portion of the arm portion 13.

The bed portion 11 is provided with a needle plate 21 on the top surface of the bed portion 11. The needle plate 21 has a needle hole (not shown in the drawings). A sewing needle 7, which will be described later, is inserted through the needle hole. Although none of the following is shown in the drawings, the sewing machine 1 is provided with a feed dog, a feed mechanism, a rotary shuttle and a shuttle drive mechanism etc. below the needle plate 21 (namely, inside the bed portion 11). During normal sewing, which is not embroidery sewing, the feed dog is driven by the feed mechanism and moves a work cloth, which is a sewing workpiece. The rotary shuttle houses a bobbin around which a lower thread is wound. The shuttle mechanism is rotatably driven by a lower shaft (not shown in the drawings), drives the rotary shuttle, and entwines an upper thread (not shown in the drawings) with the lower thread (not shown in the drawings). The lower shaft is rotatably driven in synchronization with a drive shaft that is rotatably driven by a sewing machine motor 81 that will be described later.

The sewing machine 1 is provided with an embroidery frame transport mechanism (hereinafter referred to as a "transport mechanism") 40. The transport mechanism 40 can be mounted on and removed from the bed portion 11 of the sewing machine 1. FIG. 1 shows a state in which the transport mechanism 40 is mounted on the sewing machine 1. When the transport mechanism 40 is mounted on the sewing machine 1, the transport mechanism 40 and the sewing machine 1 are electrically connected. The transport mechanism 40 is provided with a main body portion 41 and a movable portion 42. The movable portion 42 is provided on the upper side of the main body portion 41. The movable portion 42 has a cuboid shape that is long in the front-rear direction.

Figure 6:
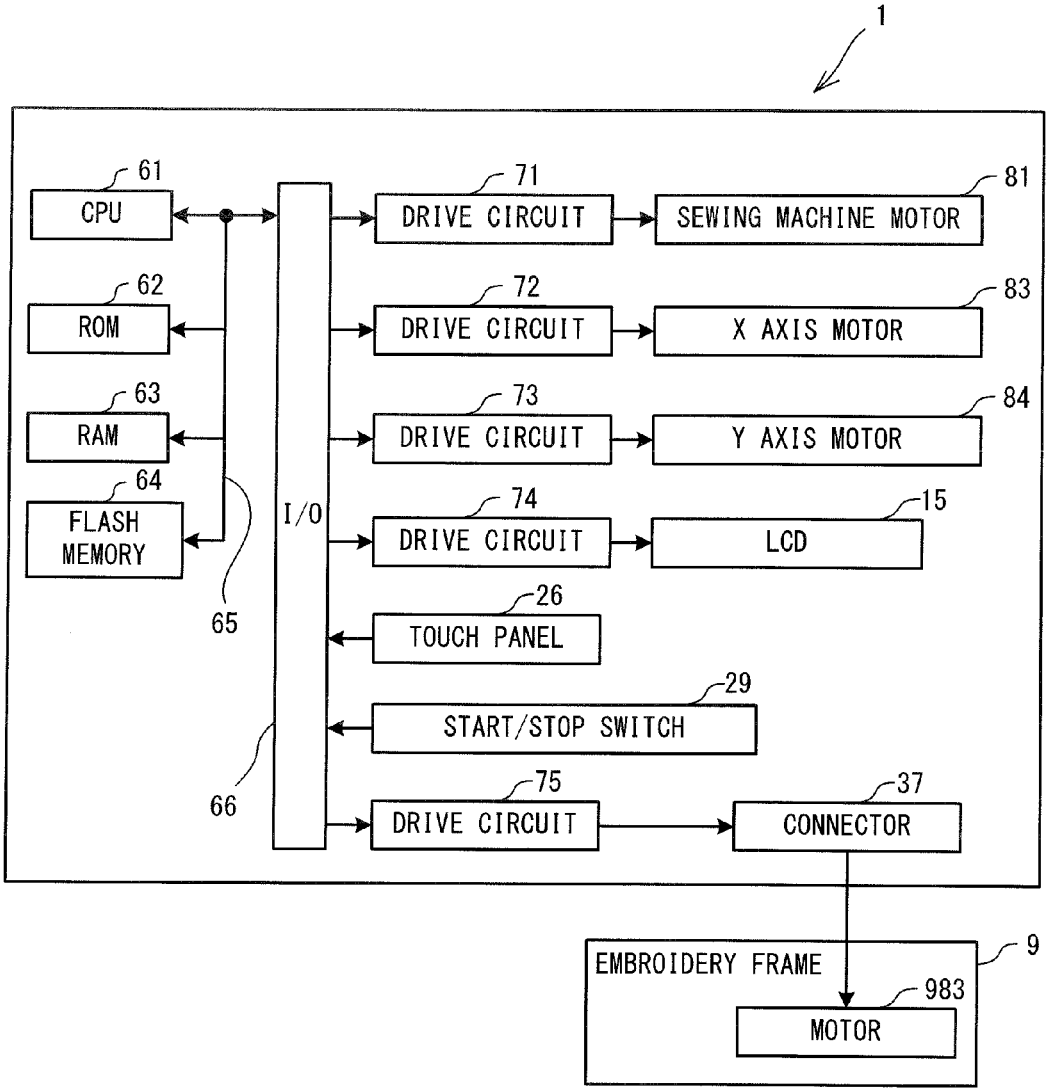
FIG. 6 is a block diagram showing an electrical configuration of the sewing machine 1.

The movable portion 42 is provided with a carriage 43, a Y axis transport mechanism (not shown in the drawings) and a Y axis motor 84 (refer to FIG. 6). The carriage 43 is provided on the right side surface of the movable portion 42. A selected one of a plurality of types of embroidery frames can be mounted on the carriage 43. The embroidery frame of the present embodiment is an embroidery frame 9 that will be described later. Instead of the embroidery frame 9, an embroidery frame (not shown in the drawings) having a known structure in which a work cloth 100 is clamped and held by an inner frame and an outer frame can be mounted on the transport mechanism 40. The carriage 43 is provided with a known detector (not shown in the drawings) that detects the type of the embroidery frame mounted on the carriage 43. For example, a mechanism described in Japanese Laid-Open Patent Publication No. 2002-52283 can be used as the detector.

The work cloth 100 (refer to FIG. 3) held by the embroidery frame 9 is arranged on the upper side of the needle plate 21 and below a needle bar 6 and a presser foot 5. The Y axis transport mechanism moves the carriage 43 in the front-rear direction (the Y axis direction). As the carriage 43 is moved in the front-rear direction, the embroidery frame 9 moves the work cloth 100 in the front-rear direction. The Y axis motor 84 drives the Y axis transport mechanism.

The main body portion 41 is internally provided with an X axis transport mechanism (not shown in the drawings) and an X axis motor 83 (refer to FIG. 6). The X axis transport mechanism moves the movable portion 42 in the left-right direction (the X axis direction). As the movable portion 42 is moved in the left-right direction, the embroidery frame 9 moves the work cloth 100 in the left-right direction. The X axis motor 83 drives the X axis transport mechanism.

The liquid crystal display (hereinafter referred to as the LCD) 15 is provided on the front surface of the pillar 12. A variety of items, such as commands, illustrations, setting values and messages etc., are displayed on the LCD 15. A touch panel 26, which can detect a pressed position, is provided on the front surface side of the LCD 15. When a user uses a finger or a stylus pen (not shown in the drawings) to perform a pressing operation of the touch panel 26, the pressed position is detected by the touch panel 26. Based on the detected pressed position, a CPU 61 (refer to FIG. 6) of the sewing machine 1 recognizes the item selected on an image. Hereinafter, the pressing operation of the touch panel 26 by the user is referred to as a panel operation. Through the panel operation, the user can select a pattern to be sewn and a command to be executed. The pillar 12 is internally provided with the sewing machine motor 81 (refer to FIG. 6).

A cover 16 that can open and close is provided on an upper portion of the arm portion 13. In FIG. 1, the cover 16 is in a closed state. Although not shown in the drawings, a thread housing portion is provided below the cover 16, namely, inside the arm portion 13. The thread housing portion can house a thread spool (not shown in the drawings) around which the upper thread is wound. The drive shaft (not shown in the drawings) that extends in the left-right direction is provided inside the arm portion 13. The drive shaft is rotatably driven by the sewing machine motor 81 (refer to FIG. 6). Various switches, including a start/stop switch 29, are provided on a lower left portion of the front surface of the arm portion 13. The start/stop switch 29 is used to start or stop operation of the sewing machine 1, namely, to input a command to start or stop sewing.

A support base 131 is provided on the rear surface of the arm portion 13. Two support bars 132, which extend in the up-down direction, are provided on the support base 131 such that the support bars 132 are arranged side by side in the left-right direction. A yarn ball 17 is disposed on the support bar 132 on the left side. For example, the yarn ball 17 is formed by winding wool, which is the string-like material 18. The string-like material 18 may be a cord, a tape or the like. A guide portion 133 is provided on the rear surface of the head portion 14. A guide portion 134 is provided on a front portion of the left end of the head portion 14. The guide portions 133 and 134 guide the string-like material 18 pulled out from the yarn ball 17. The guide portions 133 and 134 are formed by bending a wire rod, and are fixed to the head portion 14 by screws that are not shown in the drawings.

The head portion 14 is provided with the needle bar 6, a presser bar (not shown in the drawings), a needle bar up-and-down movement mechanism (not shown in the drawings) and the like. The needle bar 6 and the presser bar extend downward from a lower end portion of the head portion 14. The sewing needle 7 is detachably mounted on the lower end of the needle bar 6. The needle bar up-and-down movement mechanism drives the needle bar 6 in the up-down direction by rotation of the drive shaft.

Figure 3:
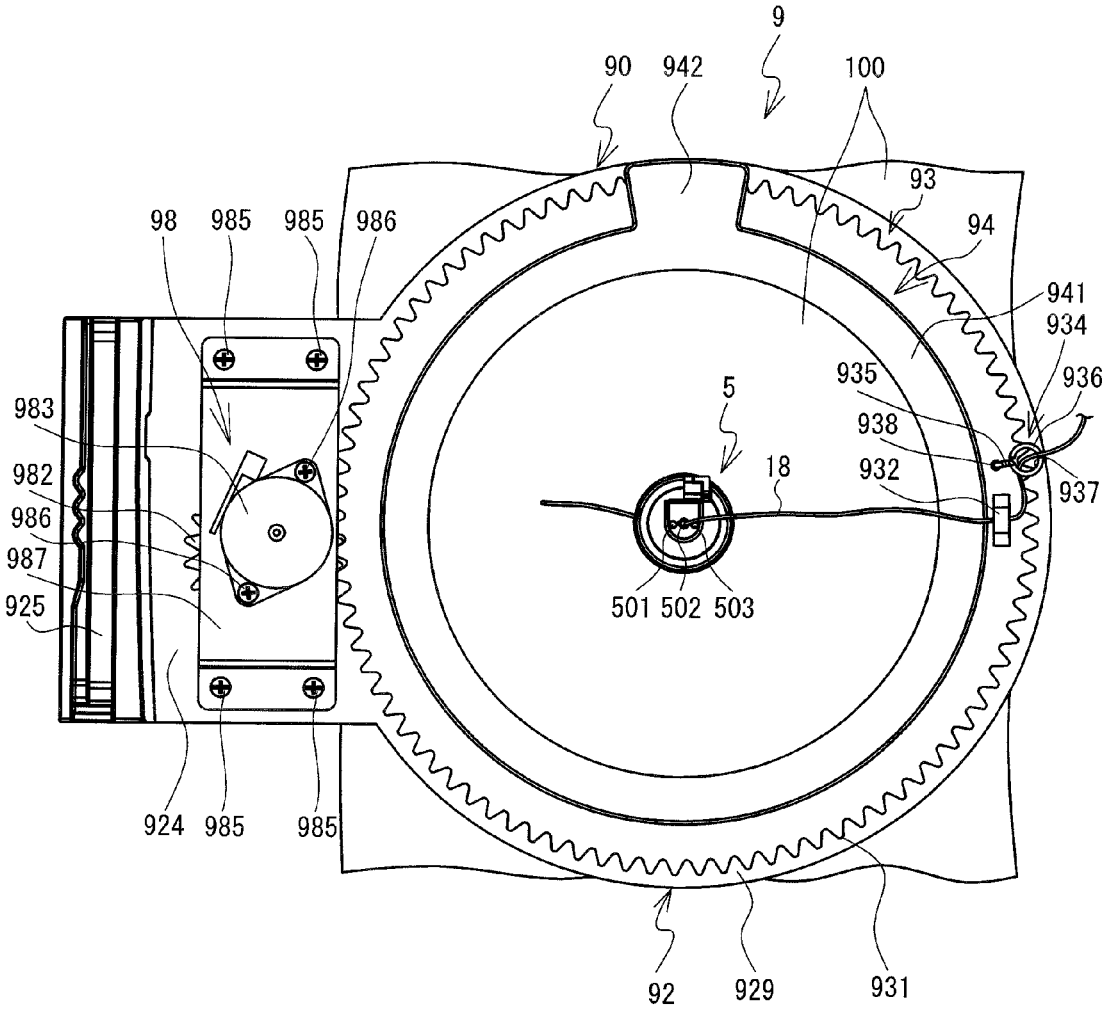
FIG. 3 is a plan view showing the embroidery frame 9 that is holding a work cloth 100, a presser foot 5, and a path of a string-like material 18.

The presser foot 5 is detachably mounted on a lower end portion of the presser bar. The presser foot 5 of the present embodiment is a presser foot that is used to sew the string-like material 18. As shown in FIG. 3, the presser foot 5 has a circular disk shape in a plan view, and an end portion on the radially outer side of the presser foot 5 is curved upward. Three hole portions 501, 502 and 503 that penetrate in the up-down direction are formed in a center portion of the presser foot 5 such that they are arranged side by side in the left-right direction. The sewing needle 7 can be inserted though the center hole portion 502 in the up-down direction. The string-like material 18 that is guided by a first guide portion 932, which will be described later, is inserted through the center hole portion 502.

Figure 2:
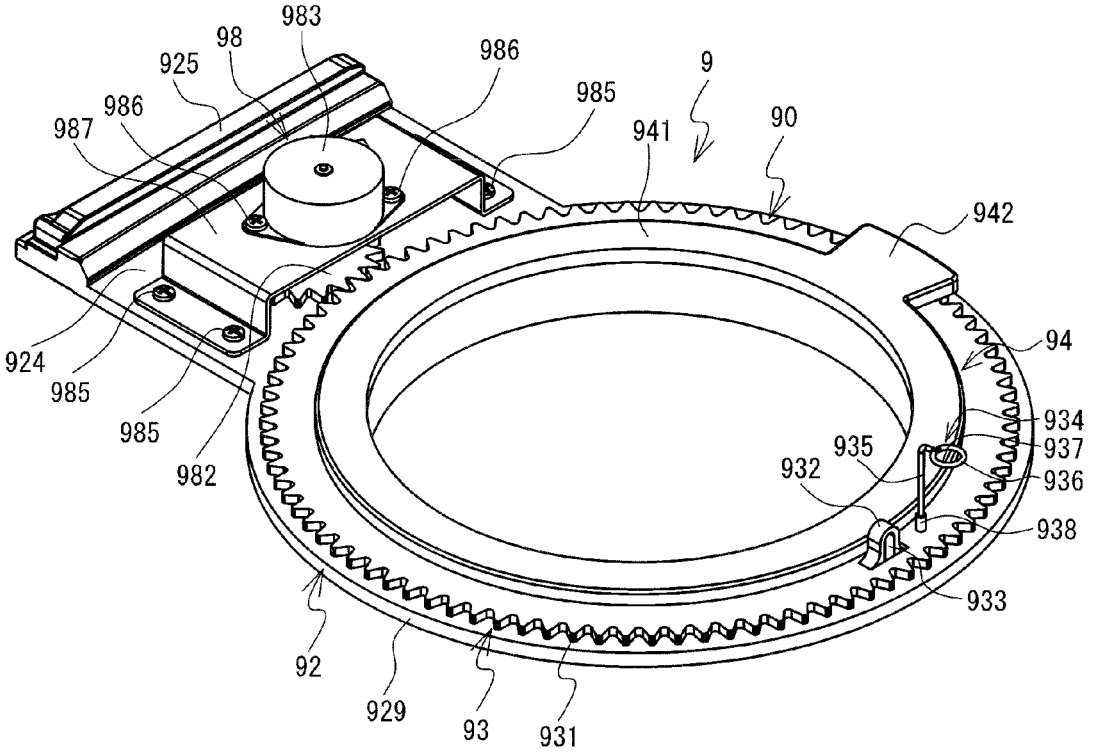
FIG. 2 is a perspective view of an embroidery frame 9.
Figure 4:
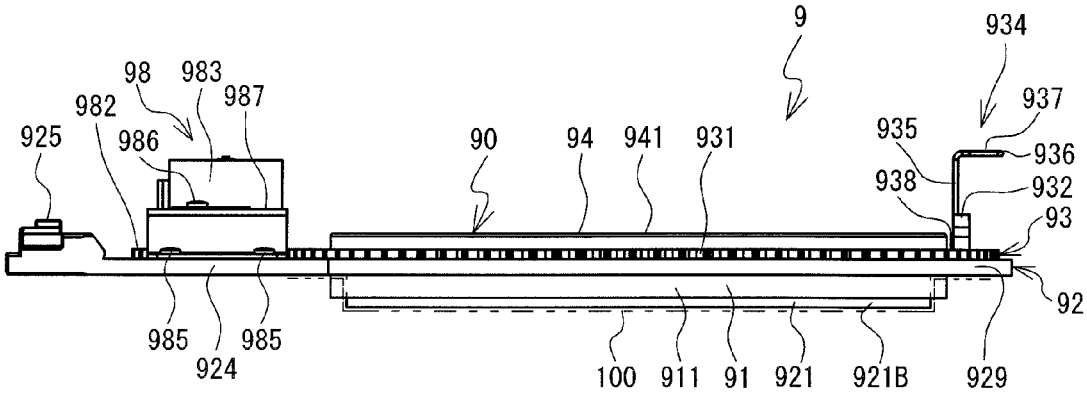
FIG. 4 is a side view of the embroidery frame 9.
Figure 5:
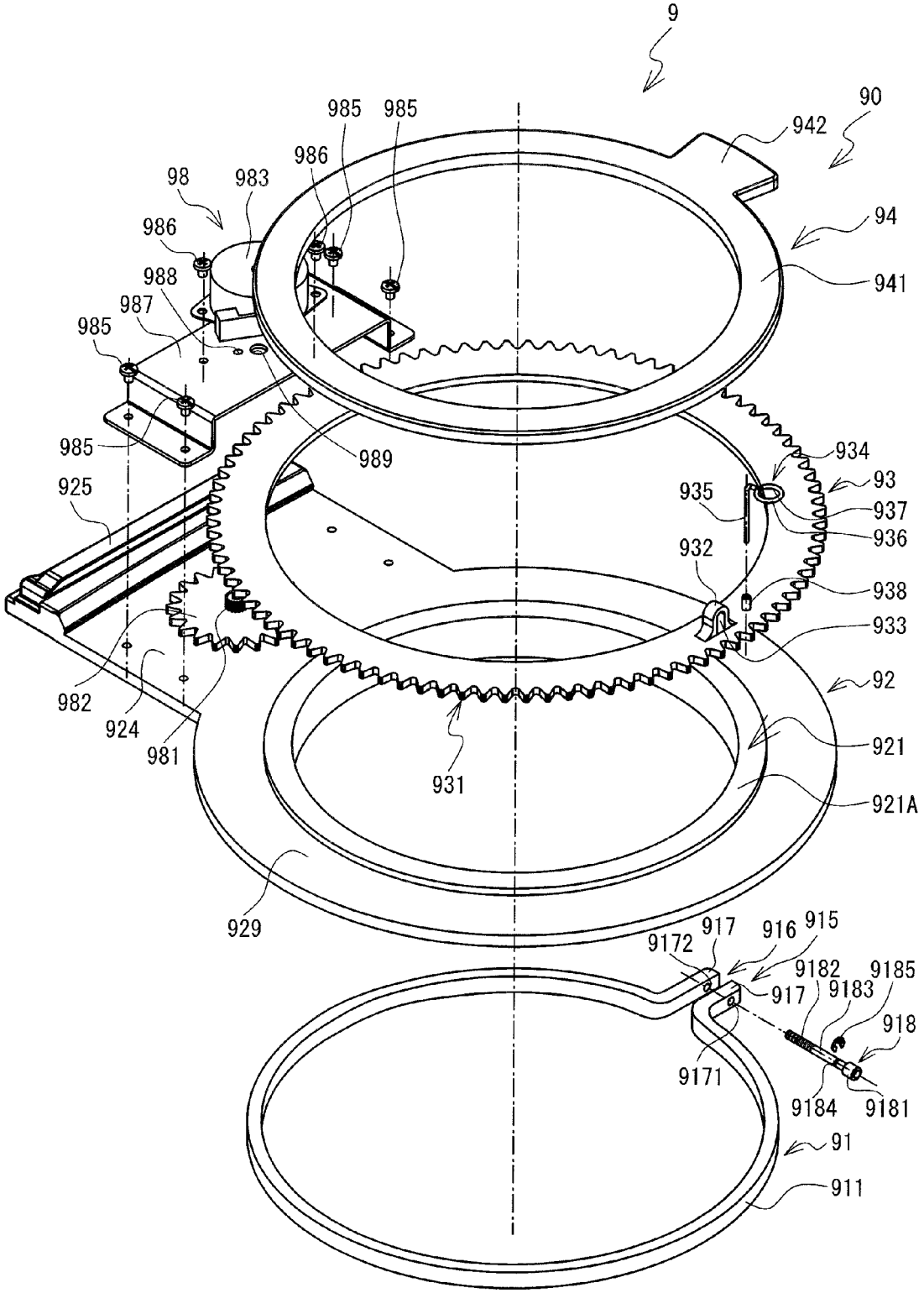
FIG. 5 is an exploded perspective view of the embroidery frame 9.

The embroidery frame 9 will be explained with reference to FIG. 2 to FIG. 5. In the explanation below, the up-down direction of FIG. 2 and FIG. 5 is referred to as the up-down direction of the embroidery frame 9. As shown in FIG. 2 to FIG. 5, the embroidery frame 9 is provided with an inner frame 90 and an outer frame 91 (refer to FIG. 5). The inner frame 90 is provided with a first frame 92, a second frame 94, a rotation member 93 and a drive mechanism 98.

As shown in FIG. 5, the first frame 92 is provided with an annular frame portion 921. The outer diameter of the frame portion 921 is smaller than the inner diameter of a frame portion 911 of the outer frame 91. An outer peripheral side surface of the frame portion 921 is provided with a flange portion 929 that protrudes toward the outside in the radial direction of the frame portion 921. A part of the frame portion 921 that is located on the upper side (namely, on the second frame 94 side) of the flange portion 929 is referred to as a frame portion 921A, and a part of the frame portion 921 that is located on the lower side (namely, on the outer frame 91 side) of the flange portion 929 is referred to as a frame portion 921B (refer to FIG. 4). The thickness of the frame portion 921A in an axis line direction (the up-down direction) is slightly larger than the thickness of the rotation member 93 in the axis line direction. The thickness of the frame portion 921B in the axis line direction is slightly larger than the thickness of the frame portion 911 (to be described later) of the outer frame 91 in the axis line direction (refer to FIG. 4). As shown in FIG. 4, when the radially inner side of the frame portion 911 (to be described later) of the outer frame 91 is fitted onto an outer peripheral side surface of the frame portion 921B of the frame portion 921, the inner frame 90 and the outer frame 91 are attached to each other.

As shown in FIG. 5, the first frame 92 is provided with an extending portion 924 that extends toward the outside in the radial direction of the frame portion 921. The extending portion 924 has a plate shape that has the same thickness as the thickness of the flange portion 929 in the axis line direction, and is formed integrally with the flange portion 929. On the radially outer side of the frame portion 921, the leading end of the extending portion 924 is provided with a mounting portion 925. In other words, the extending portion 924 couples the mounting portion 925 and the frame portion 921. The mounting portion 925 is configured such that it can be attached to and removed from the carriage 43.

As shown in FIG. 2 to FIG. 5, the drive mechanism 98 is provided on the upper side of the extending portion 924. The drive mechanism 98 rotates the rotation member 93. As shown in FIG. 5, the drive mechanism 98 is provided with a gear 981, a gear 982 and a motor 983. The outer diameter of the gear 981 is smaller than that of the gear 982. The gear 981 and the gear 982 are integrally formed. The gear 982 meshes with a frame gear 931 (to be described later) of the rotation member 93. A shaft (not shown in the drawings) that extends in the axis line direction is inserted through the center of the gears 981 and 982. An upper end portion of the shaft is axially supported by a hole 988 that extends in the up-down direction and that is provided in an attachment plate 987 (to be described later). A lower end portion of the shaft is axially supported by a hole (not shown in the drawings) that extends in the up-down direction and that is provided in the extending portion 924. The gears 981 and 982 rotate around the shaft.

The attachment plate 987 has a rectangular shape in a plan view, and is formed such that front and rear end portions of the attachment plate 987 are bent in a crank shape (in a substantial Z shape) in a side view. Four corners of the attachment plate 987 are fixed to the extending portion 924 by screws 985. The motor 983 is fixed to the top surface of the attachment plate 987 by two screws 986. The motor 983 is connected, via a cable (not shown in the drawings), to a connector 37 (refer to FIG. 6) that is provided on the rear surface of the head portion 14 of the sewing machine 1. The CPU 61 (refer to FIG. 6) can control the motor 983 via the cable. A drive shaft (not shown in the drawings) of the motor 983 penetrates a hole 989 that extends in the up-down direction and that is provided in the attachment plate 987, and protrudes below the attachment plate 987. A drive gear (not shown in the drawings) is anchored to the leading end of the drive shaft. The drive gear meshes with the gear 981. When a rotation shaft of the motor 983 rotates, the rotation member 93 rotates via the gears 981 and 982, and the first guide portion 932 and a second guide portion 934 (which will be described later) rotate and move.

As shown in FIG. 5, the rotation member 93 is an annular plate-shaped member. The inner diameter of the rotation member 93 is slightly larger than the outer shape of the frame portion 921A of the first frame 92. Therefore, the rotation member 93 is disposed around the frame portion 921A while being supported by the flange portion 929. The outer diameter of the rotation member 93 is smaller than the outer diameter of the flange portion 929. The frame gear 931 is formed around the entire periphery of an outer peripheral side surface of the rotation member 93. The frame gear 931 and the gear 982 mesh with each other (refer to FIG. 2). As shown in FIG. 2 to FIG. 5, the top surface of the rotation member 93 is provided with the first guide portion 932 and the second guide portion 934. The first guide portion 932 projects upward from the top surface of the rotation member 93. The first guide portion 932 is provided with a first through hole 933 that is formed so as to extend in the radial direction of the rotation member 93 (refer to FIG. 2 and FIG. 5). The first through hole 933 of the first guide portion 932 can guide the string-like material 18 (refer to FIG. 3).

As shown in FIG. 2 to FIG. 5, the second guide portion 934 is provided on the counter-clockwise side (in a plan view) of the first guide portion 932 in the circumferential direction of the rotation member 93. As shown in FIG. 2 and FIG. 5, the second guide portion 934 is provided with a support column portion 935 and an annular portion 936. The support column portion 935 and the annular portion 936 are formed by bending a single wire rod. The support column portion 935 extends in the up-down direction. The upper end of the support column portion 935 is bent toward the outside in the radial direction of the rotation member 93, and the annular portion 936 is formed at the tip of the upper end. The annular portion 936 is provided with a second through hole 937 that penetrates in the up-down direction. The second through hole 937 can guide the string-like material 18 to the first through hole 933 (refer to FIG. 3). The second guide portion 934 is attached to the rotation member 93 by the support column portion 935 being pressed into a hole portion (not shown in the drawings) of a cylindrical portion 938 that protrudes upward from the top surface of the rotation member 93.

As shown in FIG. 5, the second frame 94 is provided with an annular frame portion 941. The frame portion 941 is plate shaped, and a part of an outer peripheral side surface of the frame portion 941 is provided with a protruding portion 942 that protrudes toward the outside in the radial direction. The protruding portion 942 is substantially fan shaped. In a state in which the embroidery frame 9 is mounted on the carriage 43, the protruding portion 942 is in a position where it protrudes rearward. The inner diameter of the frame portion 941 is substantially the same as the inner diameter of the first frame 92. The outer diameter of the frame portion 941 is larger than the inner diameter of the rotation member 93. The second frame 94 is supported by the frame portion 921 of the first frame 92. The second frame 94 is anchored to the upper side of the first frame 92 using, for example, an adhesive. The rotation member 93 is rotatably held in a space that is formed by the second frame 94, the frame portion 941 and the flange portion 929. Positions in the radial direction of the first guide portion 932 and the second guide portion 934 of the rotation member 93 are further to the outside than the outer peripheral side surface of the frame portion 941. Therefore, the first guide portion 932 and the second guide portion 934 can rotate and move without coming into contact with the outer peripheral side surface of the frame portion 941.

As shown in FIG. 5, the outer frame 91 is provided with the annular frame portion 911. The frame portion 911 has a thickness in the axis line direction. As shown in FIG. 4, the outer peripheral side surface of the frame portion 921B of the first frame 92 can be fitted into the inside in the radial direction of the frame portion 911. As shown in FIG. 5, the outer frame 91 is provided with an adjustment portion 915. The adjustment portion 915 can adjust the diameter of the outer frame 91. The diameter of the outer frame 91 is adjusted in accordance with a cloth thickness of the work cloth 100 that is clamped between the outer frame 91 and the first frame 92. The adjustment portion 915 is provided with a divided portion 916, a pair of screw mounting portions 917 and an adjustment screw 918. The divided portion 916 is a portion that is formed such that a part in the circumference direction of the frame portion 911 of the outer frame 91 is divided along the radial direction. The pair of screw mounting portions 917 are provided on both sides of the divided portion 916 of the frame portion 911, and protrude to the outside in the radial direction such that they face each other. The pair of screw mounting portions 917 are provided with hole portions 9171 and 9172 that penetrate in a direction orthogonal to the facing surfaces of the screw mounting portions 917. A nut (not shown in the drawings), in which a screw hole is formed, is embedded in the hole portion 9172 (the hole portion on the upper left side of FIG. 5), of the two hole portions 9171 and 9172.

The adjustment screw 918 is a screw member that has a head portion 9181 with a large diameter, which is rotated by the user pinching it, and a shaft portion 9183 with a small diameter, which extends integrally from the head portion 9181. A male screw portion 9182 is formed on a section of the shaft portion 9183 that is close to the leading end of the shaft portion 9183. Further, a thin groove 9184, into which a retaining ring 9185 is fitted, is formed in a section of the shaft portion 9183 that is close to the head portion 9181. The adjustment screw 918 is mounted such that the shaft portion 9183 penetrates the hole portion 9171 and the male screw portion 9182 is screwed into the screw hole of the nut embedded in the hole portion 9172. In this state, the retaining ring 9185 is fitted into the thin groove 9184 of the shaft portion 9183, and thus the adjustment screw 918 is held by one of the screw mounting portions 917 that has the hole portion 9171, such that the adjustment screw 918 can rotate but cannot move in the axis line direction. Here, when the user pinches the head portion 9181 of the adjustment screw 918 and performs a rotation operation, one of the screw mounting portions 917 that has the hole portion 9172 moves in a direction in which the shaft portion 9183 extends. Further, the movement direction of the screw mounting portion 917 is determined by a rotation direction of the adjustment screw 918. In this manner, the adjustment screw 918 couples the pair of screw mounting portions 917 and also adjusts an interval between the pair of screw mounting portions 917 such that the interval is increased or decreased. As the interval between the pair of screw mounting portions 917 is adjusted, the diameter of the outer frame 91 is adjusted in accordance with the cloth thickness of the work cloth 100. For example, as the interval between the pair of screw mounting portions 917 is widened, the diameter of the outer frame 91 is increased. It is thus possible to clamp the work cloth 100 with a thick cloth thickness between the inner frame 90 and the outer frame 91.

Next, preparations to sew the string-like material 18 using the sewing machine 1 will be explained. First, the user separates the outer frame 91 and the inner frame 90 of the embroidery frame 9, and places the outer frame 91 on a work table (not shown in the drawings). After the user places the work cloth 100 on the upper side of the outer frame 91, the user moves the inner frame 90 downward from above the work cloth 100. As a result, while the lower edge of the frame portion 921B of the first frame 92 is pressing the work cloth 100, the frame portion 921B is inserted into the inside of the frame portion 911 of the outer frame 91. Thus, the work cloth 100 is clamped by the outer peripheral side surface of the frame portion 921B and an inner peripheral side surface of the frame portion 911 (refer to FIG. 4). Then, the user rotates the adjustment screw 918 as appropriate, and adjusts the diameter of the frame portion 911 of the outer frame 91 so that the work cloth 100 does not become displaced. In this manner, in a state in which the work cloth 100 is reliably clamped, a surface of the work cloth 100 on which sewing is performed is appropriately stretched inside of the frame portion 921B at the lower end of the frame portion 921B (refer to FIG. 4).

Next, the user sets the upper thread and the lower thread (which are not shown in the drawings) respectively on the sewing machine 1, and mounts the embroidery frame 9 on the carriage 43, as shown in FIG. 1. Note that an illustration of the work cloth 100 is omitted in FIG. 1. Then, the user pulls out the string-like material 18 from the yarn ball 17 and passes the string-like material 18 through the guide portions 133 and 134. Further, as shown in FIG. 3, the user causes the string-like material 18 to pass through the second through hole 937 of the second guide portion 934 from the upper side to the lower side of the second through hole 937. After that, the user causes the string-like material 18 to pass through the first through hole 933 (refer to FIG. 2) of the first guide portion 932 from the outside to the inside in the radial direction of the rotation member 93. Finally, the user causes the string-like material 18 to pass through the hole portion 502 of the presser foot 5.

An electrical configuration of the sewing machine 1 will be explained with reference to FIG. 6. As shown in FIG. 6, the sewing machine 1 is provided with the CPU 61, and with a ROM 62, a RAM 63, a flash memory 64 and an input-output interface (I/O) 66 that are respectively connected to the CPU 61 by a bus 65.

The CPU 61 performs main control of the sewing machine 1, and performs various types of arithmetic operations and processing relating to sewing in accordance with various programs that are stored in the ROM 62. Although not shown in the drawings, the ROM 62 is provided with a plurality of storage areas including a program storage area and a pattern storage area. Various programs to operate the sewing machine 1 are stored in the program storage area. The stored programs include, for example, a program for the sewing machine 1 to execute embroidery sewing processing (refer to FIG. 9) that will be described later. Embroidery data to sew various types of patterns is stored in the pattern storage area.

A storage area that stores arithmetic operation results etc. obtained by arithmetic processing by the CPU 61 is provided in the RAM 63 according to need. Various parameters and the like for the sewing machine 1 to execute various types of processing are stored in the flash memory 64. Drive circuits 71 to 75, the touch panel 26 and the start/stop switch 29 are connected to the I/O 66.

The sewing machine motor 81 is connected to the drive circuit 71. The drive circuit 71 drives the sewing machine motor 81 in accordance with a control signal from the CPU 61. In accordance with the driving of the sewing machine motor 81, the needle bar up-and-down movement mechanism (not shown in the drawings) is driven via the drive shaft (not shown in the drawings) of the sewing machine 1, and the needle bar 6 (refer to FIG. 1) is moved up and down. The X axis motor 83 is connected to the drive circuit 72. The Y axis motor 84 is connected to the drive circuit 73. The drive circuit 75 is connected to the motor 983 of the embroidery frame 9 via the connector 37 and the cable (not shown in the drawings). The drive circuits 72, 73 and 75 drive the X axis motor 83, the Y axis motor 84 and the motor 983, respectively, in accordance with a control signal from the CPU 61. In accordance with the driving of the X axis motor 83 and the Y axis motor 84, the embroidery frame 9 is moved in the left-right direction (the X axis direction) and in the front-rear direction (the Y axis direction) by a movement amount corresponding to the control signal. In accordance with the driving of the motor 983, the rotation member 93 of the embroidery frame 9 is rotated by a rotation amount corresponding to the control signal. The drive circuit 74 drives the LCD 15 in accordance with a control signal from the CPU 61, and thus causes the LCD 15 to display an image.

Embroidery data 80 of the present embodiment will be explained as one example of embroidery data with reference to FIG. 7. The embroidery data 80 is data that is used to sew an embroidery pattern 200 (refer to FIG. 8) such that the string-like material 18 is sewn in a rectangular shape onto the work cloth 100. The embroidery data 80 is stored in the ROM 62 (refer to FIG. 6). Note that only a part of the work cloth 100 that is on the inside of the frame portion 921 is illustrated in FIG. 8 and FIG. 11 to FIG. 14.

Figure 8:
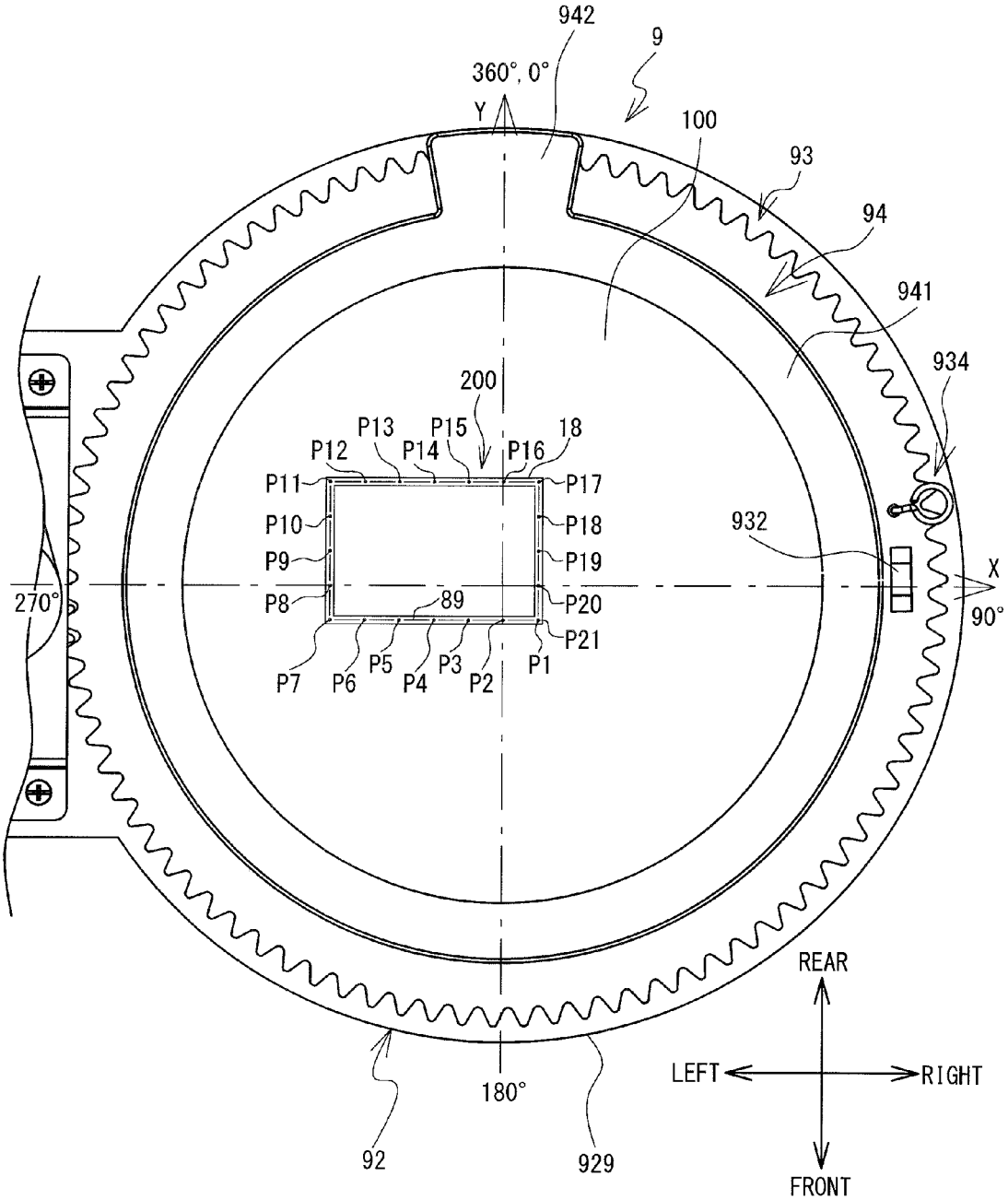
FIG. 8 is a view showing an embroidery pattern 200 sewn on the work cloth 100 held by the embroidery frame 9 that has been mounted on a carriage 43.

As shown in FIG. 7, the embroidery data 80 includes fields of a number of stitches, an X coordinate, a Y coordinate and a rotation angle, and data that is associated with each of the items is stored. The number of stitches is data that indicates the number (the number of times) that the sewing needle 7 pierces the work cloth 100, and represents a sewing order. The X coordinate and the Y coordinate are data that indicates coordinates of a position to which the CPU 61 moves the embroidery frame 9 for each stitch. The rotation angle is data that indicates a preset rotation angle by which the rotation member 93 is rotated. The rotation angle is set to an angle at which the first guide portion 932 (refer to FIG. 11) is arranged. Note that, in the present embodiment, in a state in which the embroidery frame 9 is mounted on the carriage 43, a center point of the frame portion 921 of the embroidery frame 9 is in a position that matches a needle drop point, and coordinates of this position are defined as an origin (at which the X coordinate is "0" and the Y coordinate is "0"). Note that the needle drop point is a point at which the sewing needle 7 pierces the work cloth and matches a center point of the center hole portion 502 that is formed in the presser foot 5. Further, it is assumed that coordinates in the left-right direction of the embroidery frame 9 are X coordinates, and coordinates in the front-rear direction of the embroidery frame 9 are Y coordinates (refer to FIG. 8). Further, the positive direction of the Y axis from the origin is defined as a reference orientation, and a clockwise angle in a plan view is defined as a positive angle (refer to FIG. 8). In the order from the number of stitches "1" to "21", the position of the first guide portion 932 of the rotation member 93 is matched with the rotation angle in the embroidery data 80. Then, while the string-like material 18 is being supplied to the sewing needle 7, the embroidery frame 9 is moved such that the position indicated by the X coordinate and the Y coordinate is positioned at the needle drop point. At the same time, the needle bar 6 (refer to FIG. 1) is driven and sewing is performed on the work cloth 100. Thus, as shown in FIG. 8, the sewing needle 7 pierces positions of points P1 to P21, stitches 89 are formed by the upper thread and the lower thread (not shown in the drawings) along the string-like material 18, and the string-like material 18 is sewn onto the work cloth 100.

The embroidery sewing processing will be explained with reference to FIG. 9. As an example, a case will be explained in which the user selects the embroidery pattern 200 (refer to FIG. 8) by a panel operation, and inputs a start command to start the embroidery sewing processing. When the CPU 61 detects the input of the start command of the embroidery sewing processing, the CPU 61 reads the program to execute the embroidery sewing processing from the ROM 62 (refer to FIG. 6) into the RAM 63, and performs processing of each of steps that will be explained below, in accordance with instructions included in the program. Before inputting the start command, the user mounts the embroidery frame 9 that is holding the work cloth 100 on the carriage 43.

Figure 9:
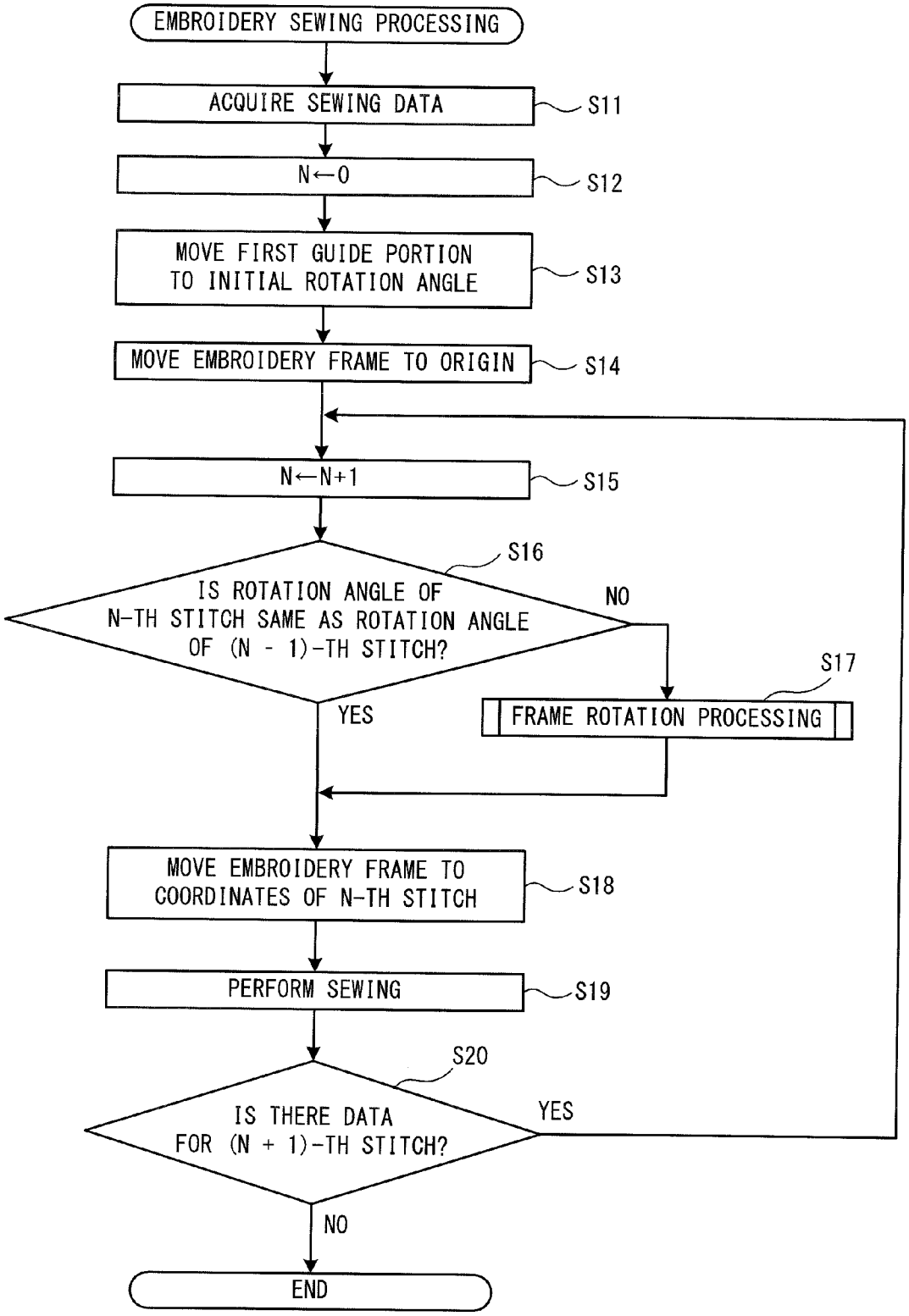
FIG. 9 is a flowchart of embroidery sewing processing.

As shown in FIG. 9, in the embroidery sewing processing, the CPU 61 first acquires the embroidery data 80 (refer to FIG. 7) of the embroidery pattern 200 selected at the start of the embroidery sewing processing (step S11). More specifically, the CPU 61 acquires the embroidery data 80 from the ROM 62 and stores it in the RAM 63. Next, the CPU 61 sets a variable N, which indicates a number of the stitches, to 0 and stores it in the RAM 63 (step S12).

The CPU 61 moves the first guide portion 932 to an initial rotation angle (step S13). The initial rotation angle is an angle at which the first guide portion 932 comes into contact with the left end of the protruding portion 942. The CPU 61 drives the motor 983 to rotate the rotation member 93 in a clockwise direction in a plan view, and stops the driving of the motor 983 at the position where the first guide portion 932 comes into contact with the left end of the protruding portion 942. In this manner, the CPU 61 moves the first guide portion 932 to the initial rotation angle. The initial rotation angle is 340 degrees. Next, the CPU 61 moves the carriage 43 by driving the X axis motor 83 and the Y axis motor 84, and moves the embroidery frame 9 to a position where the origin of the embroidery frame 9 matches the needle drop point (step S14).

Next, the CPU 61 increments the variable N and stores it in the RAM 63 (step S15). Next, the CPU 61 refers to the embroidery data 80 and determines whether the rotation angle of an N-th stitch is the same as the rotation angle of an (N−1)-th stitch (step S16). Note that when the variable N is 1, the rotation angle of a 0-th stitch is the initial rotation angle to which the first guide portion 932 was moved at step S13. The initial rotation angle is stored in the ROM 62 in advance. When the rotation angle of the N-th stitch is the same as the rotation angle of the (N−1)-th stitch (yes at step S16), the CPU 61 performs step S18 that will be described later. When the rotation angle of the N-th stitch is not the same as the rotation angle of the (N−1)-th stitch (no at step S16), the CPU 61 performs frame rotation processing (step S17).

Figure 10:
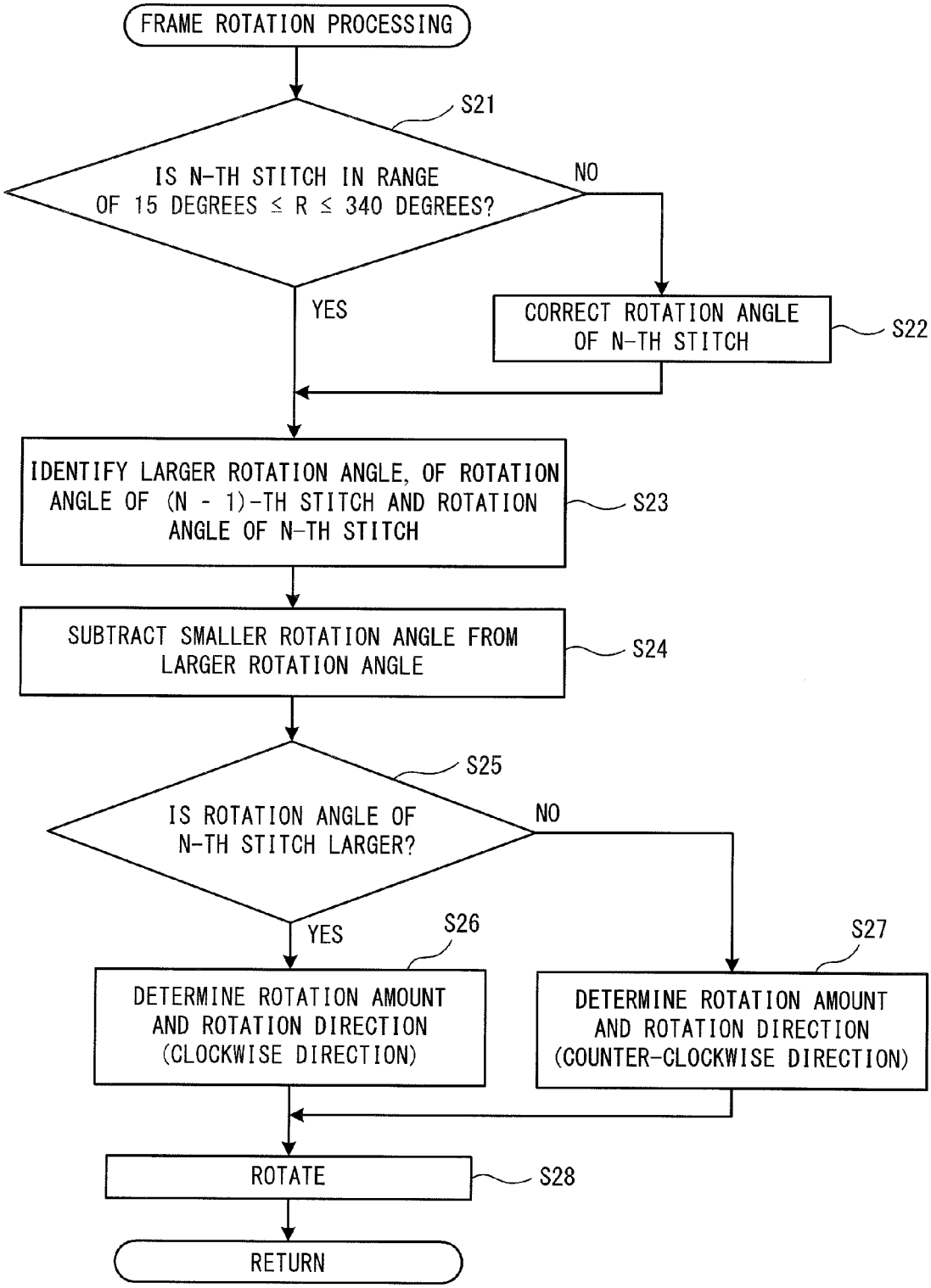
FIG. 10 is a flowchart of frame rotation processing.

The frame rotation processing will be explained with reference to FIG. 10. The frame rotation processing is processing that rotates the rotation member 93 of the embroidery frame 9 and changes the rotation angle of the first guide portion 932. The CPU 61 refers to the embroidery data 80 and determines whether a rotation angle R of the N-th stitch is in a range of 15 degrees≤R≤340 degrees (step S21). Note that the angle range that is equal to or more than 15 degrees and equal to or less than 340 degrees is a range in which the first guide portion 932 or the second guide portion 934 can move without being restricted by the protruding portion 942 (refer to FIG. 8). When the rotation angle R of the N-th stitch is in the range of 15 degrees≤R≤340 degrees (yes at step S21), the CPU 61 advances the processing to step S23 that will be described later. For example, when the variable N=1, the rotation angle of the first stitch is 265 degrees (refer to FIG. 7). Therefore, the CPU 61 determines that the rotation angle R of the first stitch is in the range of 15 degrees≤R≤340 degrees (yes at step S21), and advances the processing to step S23 that will be described later.

When the rotation angle R of the N-th stitch is in a range of 0 degrees≤R<15 degrees or 340 degrees<R<360 degrees (no at step S21), the CPU 61 corrects the rotation angle of the N-th stitch (step S22). More specifically, when the rotation angle R of the N-th stitch is in the range of 0 degrees≤R≤15 degrees, the CPU 61 changes the rotation angle of the N-th stitch to 15 degrees. When the rotation angle R of the N-th stitch is in the range of 340 degrees<R<360 degrees, the CPU 61 changes the rotation angle of the N-th stitch to 340 degrees. In other words, the rotation angle is corrected to a range in which the first guide portion 932 or the second guide portion 934 can move without being restricted by the protruding portion 942 (refer to FIG. 8).

Next, the CPU 61 refers to the embroidery data 80 (refer to FIG. 7) and identifies, among the rotation angle of the (N−1)-th stitch and the rotation angle of the N-th stitch, a larger rotation angle (step S23). Note that, when the value (N−1) is 0, the rotation angle of the 0-th stitch is the initial rotation angle. Next, the CPU 61 subtracts the smaller rotation angle from the larger rotation angle identified at step S23 (step S24). The CPU 61 stores a calculation result in the RAM 63.

Next, the CPU 61 determines whether the rotation angle of the N-th stitch is larger than the rotation angle of the (N−1)-th stitch (step S25). When the rotation angle of the N-th stitch is larger than the rotation angle of the (N−1)-th stitch (yes at step S25), the CPU 61 determines the calculation result at step S24 to be a rotation amount, and determines the rotation direction of the rotation member 93 to be clockwise in a plan view (step S26). More specifically, the CPU 61 sets the value of the calculation result at step S24 as the rotation amount of the embroidery frame 9. In this case, the rotation amount is a positive value. When the rotation amount is a positive value, the rotation direction of the rotation member 93 is determined to be clockwise in a plan view.

When the rotation angle of the N-th stitch is smaller than the rotation angle of the (N−1)-th stitch (no at step S25), the CPU 61 determines the value of the calculation result at step S24 as a rotation amount of the embroidery frame 9, and determines the rotation direction of the rotation member 93 to be counter-clockwise in a plan view (step S27). More specifically, the CPU 61 determines a value obtained by multiplying the calculation result at step S24 by "−1" as the rotation amount. In this case, the rotation amount is a negative value. When the rotation amount is a negative value, the rotation direction of the rotation member 93 is counter-clockwise in a plan view. In this manner, when the rotation angle of the N-th stitch is larger than the rotation angle of the (N−1)-th stitch, the rotation direction is determined to be clockwise (step S26), and when the rotation angle of the N-th stitch is smaller than the rotation angle of the (N−1)-th stitch, the rotation direction of the rotation member 93 is determined to be counter-clockwise (step S27). In this manner, the rotation range R of the first guide portion 932 is restricted to the range of 15 degrees≤R≤340 degrees. In other words, the first guide portion 932 does not pass through a range that is equal to or larger than 0 degrees and less than 15 degrees, and a range that is larger than 340 degrees and less than 360 degrees.

After performing step S26 or step S27, the CPU 61 drives the motor 983 and rotates the rotation member 93 by the rotation amount determined at step S26 or step S27 (step S28). At this time, the CPU 61 controls the drive mechanism 98 such that the rotation member 93 is rotated in the rotation direction determined at step S26 or step S27. When the rotation amount is a positive value, the CPU 61 rotates the rotation member 93 clockwise in a plan view. When the rotation amount is a negative value, the CPU 61 rotates the rotation member 93 counter-clockwise in a plan view. Note that the work cloth 100 does not move in conjunction with the rotation of the rotation member 93, and therefore does not rotate.

For example, when the variable N=1, the rotation angle of the first stitch is 265 degrees, and the rotation angle of the 0-th stitch (the initial rotation angle) is 340 degrees. The CPU 61 calculates a value obtained by subtracting 265 degrees, which is the rotation angle of the first stitch, from 340 degrees, which is the rotation angle of the 0-th stitch, thus obtaining 75 degrees (step S24). The CPU 61 determines that 265 degrees, which is the rotation angle of the first stitch, is smaller than 340 degrees, which is the rotation angle of the 0-th stitch (the initial rotation angle) (no at step S25), and determines that the rotation amount is "−75 degrees" (step S27). As shown by an arrow 820 shown in FIG. 11, the CPU 61 rotates the rotation member 93 counter-clockwise in a plan view by 75 degrees, and rotates and moves the first guide portion 932 (step S28). As a result, the first guide portion 932 is arranged at a position of the rotation angle of "265 degrees." The CPU 61 ends the frame rotation processing and returns the processing to the embroidery sewing processing (refer to FIG. 9).

As shown in FIG. 9, the CPU 61 moves the carriage 43 by driving the X axis motor 83 and the Y axis motor 84, and moves the embroidery frame 9 such that the X coordinate and the Y coordinate of the N-th stitch in the embroidery data 80 are located at the needle drop point (step S18). The CPU 61 drives the sewing machine motor 81 and sews the N-th stitch (step S19). Thus, the N-th stitch is formed and the string-like material 18 is sewn onto the work cloth 100. For example, when the variable N=1, the CPU 61 moves the embroidery frame 9 such that the X coordinate "1" and the Y coordinate "−1" of the first stitch are located at the needle drop point (step S18). Then, the CPU 61 drives the sewing machine motor 81, drives the needle bar up-and-down movement mechanism and the shuttle mechanism, and sews the first stitch at the point P1 shown in FIG. 11 (step S19).

Next, it is determined whether data of the (N+1)-th stitch exists in the embroidery data 80 (step S20). When the data of the (N+1)-th stitch exists (yes at step S20), the CPU 61 returns the processing to step S15.

Figure 11:
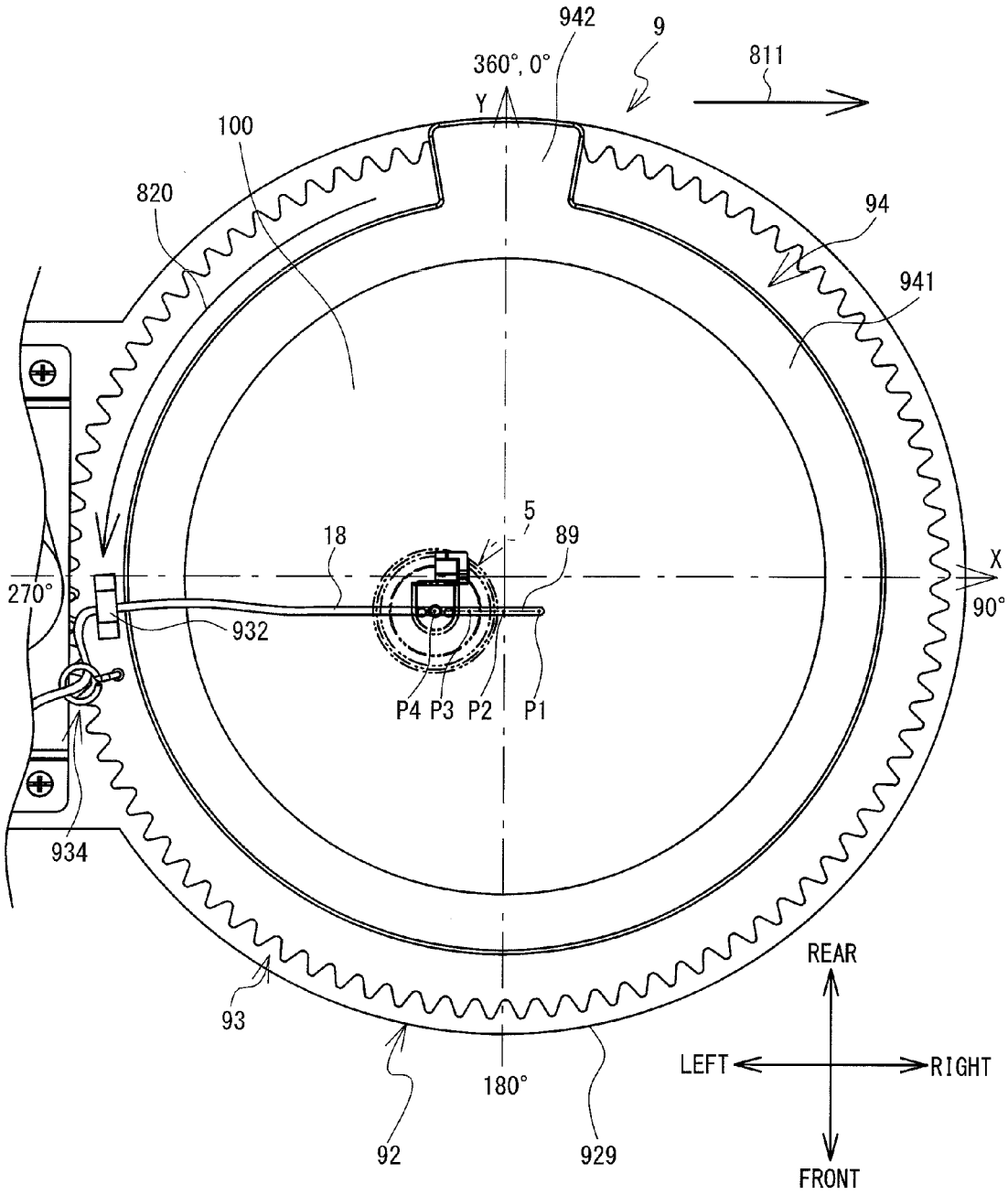
FIG. 11 is a view showing a sewing process of the embroidery pattern 200 shown in FIG. 8.

For example, in the embroidery data 80 (refer to FIG. 7), for the number of stitches 1 to 7, the rotation angle of the first guide portion 932 is 265 degrees. Therefore, when the variable N is 2 to 7, the CPU 61 determines that the rotation angle of the N-th stitch is the same as the rotation angle of the (N−1)-th stitch (yes at step S16). The CPU 61 moves the embroidery frame 9 while maintaining the rotation angle of the first guide portion 932 at 265 degrees (step S18), and performs sewing at the points P2 to P7 (step S19). At this time, as shown in FIG. 11, the CPU 61 moves the embroidery frame 9 to the right as shown by an arrow 811 (step S18). The first guide portion 932 is located in a direction opposite to the movement direction (refer to the arrow 811) of the embroidery frame 9 with respect to the needle drop point. Therefore, the stitches 89 are formed so as to overlap with the string-like material 18 that is arranged such that it extends in the direction opposite to the movement direction of the embroidery frame 9.

When the eighth stitch is sewn, the CPU 61 determines that the rotation angle of the eighth stitch is not the same as the rotation angle of the seventh stitch (no at step S16), and the CPU 61 performs the frame rotation processing (step S17). The rotation angle of the eighth stitch, which is 333 degrees, is larger than the rotation angle of the seventh stitch, which is 265 degrees. Therefore, the CPU 61 determines the rotation amount to be "+68 degrees" (step S26). At step S28, the CPU 61 rotates the rotation member 93 clockwise by 68 degrees, and thus rotates and moves the first guide portion 932 to the position of 333 degrees (refer to an arrow 821 in FIG. 12). The string-like material 18 is arranged such that it extends in a direction opposite to the movement direction (refer to an arrow 812) of the embroidery frame 9 at the eighth stitch. Next, the CPU 61 moves the embroidery frame 9 to the front (refer to the arrow 812) so that the X coordinate "−5" and the Y coordinate "0" are located at the needle drop point (step S18), and sews the eighth stitch at the point P8 (step S19). Thus, the stitches 89 are formed so as to overlap with the string-like material 18 that is arranged such that it extends in the direction opposite to the movement direction (refer to the arrow 812) of the embroidery frame 9.

Figure 12:
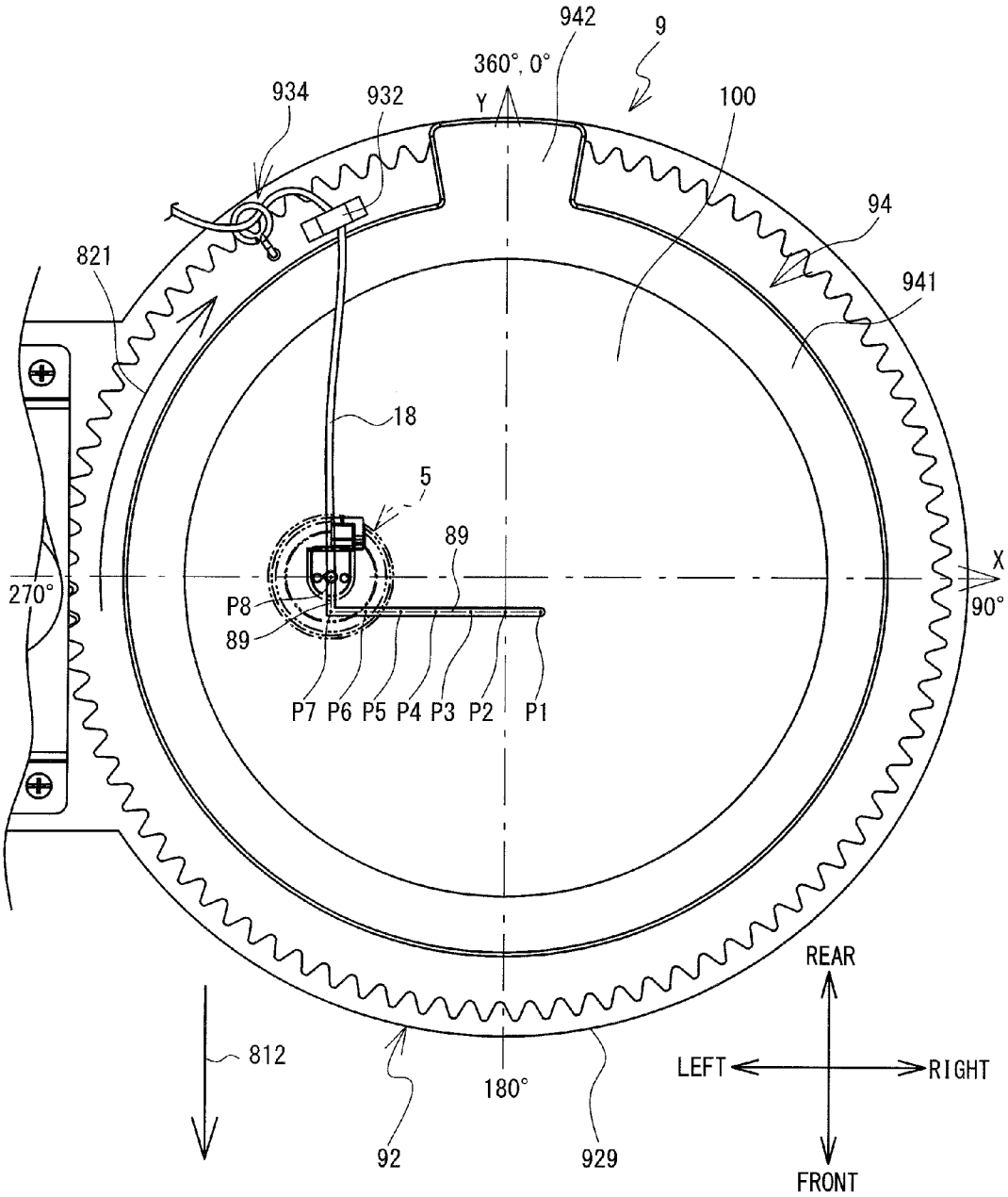
FIG. 12 is a view showing a sewing process, which is a continuation of FIG. 11.

In the embroidery data 80 (refer to FIG. 7), for the number of stitches 8 to 11, the rotation angle of the first guide portion 932 is 333 degrees. Therefore, when the variable N is 9 to 11, the CPU 61 determines that the rotation angle of the N-th stitch is the same as the rotation angle of the (N−1)-th stitch (yes at step S16). The CPU 61 moves the embroidery frame 9 while maintaining the rotation angle of the first guide portion 932 at 333 degrees (step S18), and performs sewing at the points P9 to P11 (step S19). At this time, as shown in FIG. 12, the CPU 61 moves the embroidery frame 9 to the front as shown by the arrow 812 (step S18). The first guide portion 932 is located in a direction opposite to the movement direction (refer to the arrow 812) of the embroidery frame 9 with respect to the needle drop point. Therefore, the stitches 89 are formed so as to overlap with the string-like material 18 that is arranged such that it extends in the direction opposite to the movement direction of the embroidery frame 9.

When the twelfth stitch is sewn, the CPU 61 determines that the rotation angle of the twelfth stitch and the rotation angle of the eleventh stitch are not the same (no at step S16), and performs the frame rotation processing (step S17). The rotation angle of the twelfth stitch, which is 75 degrees, is smaller than the rotation angle of the eleventh stitch, which is 333 degrees. Therefore, the CPU 61 determines the rotation amount to be "−258 degrees" (step S27). At step S28, the CPU 61 rotates the rotation member 93 counter-clockwise by 258 degrees, and rotates and moves the first guide portion 932 to a position of 75 degrees (refer to an arrow 822 in FIG. 13). The string-like material 18 is arranged such that it extends in a direction opposite to the movement direction (refer to an arrow 813) of the embroidery frame 9 at the twelfth stitch. Next, the CPU 61 moves the embroidery frame 9 to the left (refer to the arrow 813 in FIG. 13) so that the X coordinate "−4" and the Y coordinate "3" are located at the needle drop point (step S18), and sews the twelfth stitch at the point P12 (step S19). Therefore, the stitches 89 are formed so as to overlap with the string-like material 18 that is arranged such that it extends in the direction opposite to the movement direction (refer to the arrow 813) of the embroidery frame 9.

Figure 13:
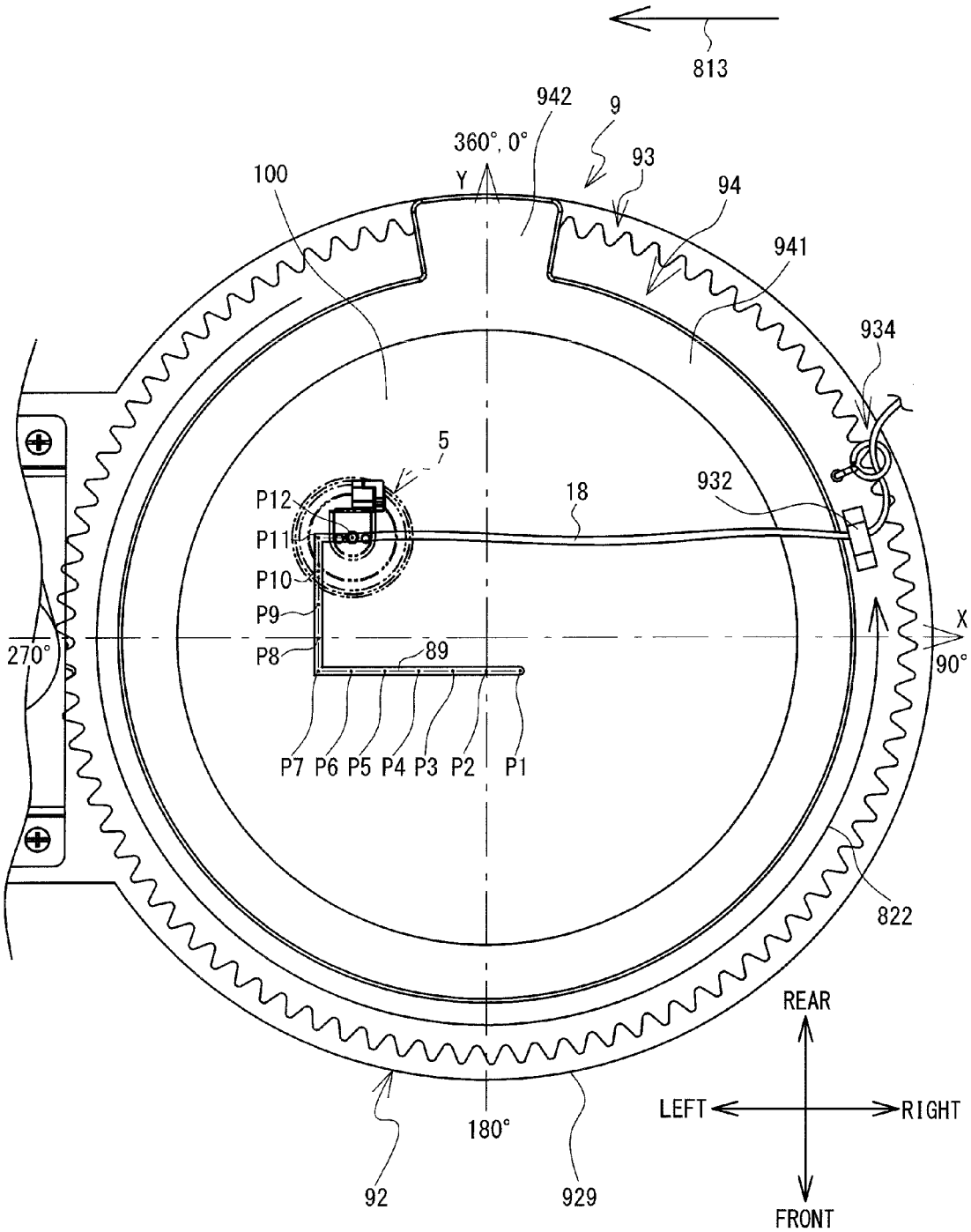
FIG. 13 is a view showing a sewing process, which is a continuation of FIG. 12.

In the embroidery data 80 (refer to FIG. 7), for the number of stitches 13 to 17, the rotation angle of the first guide portion 932 is 75 degrees. Therefore, when the variable N is 14 to 17, the CPU 61 determines that the rotation angle of the N-th stitch is the same as the rotation angle of the (N−1)-th stitch (yes at step S16). The CPU 61 moves the embroidery frame 9 while maintaining the rotation angle of the first guide portion 932 at 75 degrees (step S18), and performs sewing at the points P14 to P17 (step S19). At this time, as shown in FIG. 13, the CPU 61 moves the embroidery frame 9 to the left as shown by the arrow 813 (step S18). The first guide portion 932 is located in a direction opposite to the movement direction (refer to the arrow 813) of the embroidery frame 9 with respect to the needle drop point. Therefore, the stitches 89 are formed so as to overlap with the string-like material 18 that is arranged such that it extends in the direction opposite to the movement direction of the embroidery frame 9.

Figure 14:
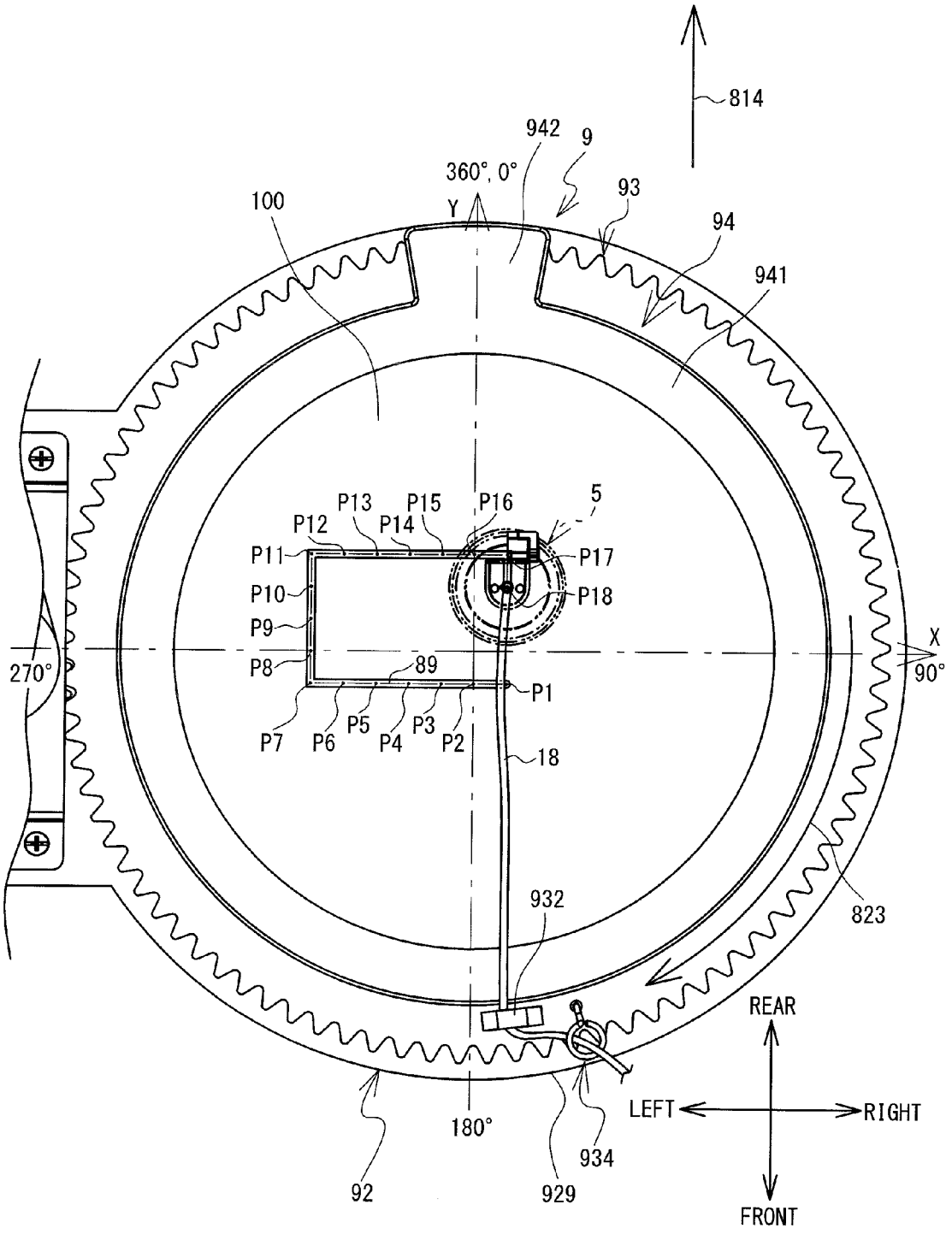
FIG. 14 is a view showing a sewing process, which is a continuation of FIG. 13.

In a similar manner, when the eighteenth stitch is sewn, at step S28, the CPU 61 rotates the rotation member 93 clockwise by 100 degrees, and rotates and moves the first guide portion 932 to a position of 175 degrees (refer to an arrow 823 in FIG. 14). Next, the CPU 61 moves the embroidery frame 9 to the rear (refer to an arrow 814 in FIG. 14) so that the X coordinate "1" and the Y coordinate "2" are located at the needle drop point (step S18), and sews the eighteenth stitch at the point P18 (step S19). Therefore, the stitches 89 are formed so as to overlap with the string-like material 18 that is arranged such that it extends in a direction opposite to the movement direction (refer to the arrow 814) of the embroidery frame 9.

The CPU 61 moves the embroidery frame 9 while maintaining the rotation angle of the first guide portion 932 at 175 degrees (step S18), and performs sewing at the points P19 to P21 (step S19). At this time, as shown in FIG. 14, the CPU 61 moves the embroidery frame 9 to the rear as shown by the arrow 814 (step S18). The first guide portion 932 is located in a direction opposite to the movement direction (refer to the arrow 814) of the embroidery frame 9 with respect to the needle drop point. Therefore, the stitches 89 are formed so as to overlap with the string-like material 18 that is arranged such that it extends in the direction opposite to the movement direction of the embroidery frame 9. Thus, the embroidery pattern 200 shown in FIG. 8 is complete. When the sewing is performed up to the twenty-first stitch and it is determined that there is no data for the (N+1)-th stitch (no at step S20), the CPU 61 ends the embroidery sewing processing.

The embroidery sewing processing of the present embodiment is performed as described above. The embroidery frame 9 can be mounted on the transport mechanism 40 that is used to perform embroidery sewing using the domestic sewing machine 1. Therefore, there is no need to provide a special rotation mechanism in the main body of the sewing machine 1 in order to perform embroidery sewing of the string-like material 18. The sewing machine 1 can hold the work cloth 100 between the frame portion 921 and the frame portion 911. Further, the first guide portion 932 has the first through hole 933 to guide the string-like material 18. Therefore, the first guide portion 932 allows the string-like material 18 to pass through the first through hole 933 and thus can guide the string-like material 18 toward the inside of the frame portion 921. Since the first guide portion 932 is provided on the rotation member 93, the first guide portion 932 can rotate and move in accordance with the rotation of the rotation member 93. Therefore, the sewing machine 1 moves the first guide portion 932 by controlling the drive mechanism 98, and moves the work cloth 100 while changing the direction in which the string-like material 18 is guided toward the inside of the frame portion 921. At the same time, the sewing machine 1 can automatically perform embroidery sewing such that the string-like material 18 is sewn onto the work cloth 100 on the inside of the frame portion 921.

Further, the first through hole 933 of the first guide portion 932 is formed so as to extend in the radial direction of the rotation member 93 (refer to FIG. 2). Therefore, the string-like material 18, which is guided by being inserted through the first through hole 933, is guided from the outside toward the inside of the rotation member 93. It is thus possible to smoothly supply the string-like material 18 from the outside toward the inside of the rotation member 93.

Further, in addition to the first guide portion 932, the embroidery frame 9 is provided with the second guide portion 934 that has the second through hole 937. It is therefore possible to guide the string-like material 18 toward the inside of the frame portion 921 via the second through hole 937 and the first through hole 933. Thus, in comparison to a case in which the string-like material 18 is guided only by the first guide portion 932, it is possible to reliably guide the string-like material 18.

Further, the embroidery frame 9 is provided with the frame gear 931 that is provided on the outer peripheral side surface of the rotation member 93, the gear 982 that meshes with the frame gear 931, and the motor 983 that drives the gear 982. Therefore, by driving the motor 983, the sewing machine 1 can rotate the rotation member 93.

Further, the drive mechanism 98 is provided on the extending portion 924 that connects the frame portion 921 and the mounting portion 925. Here, it is needless to say that the drive mechanism 98 may be provided on a portion other than the extending portion 924. However, the space to arrange the drive mechanism 98 can be reduced by providing the drive mechanism 98 on the extending portion 924.

Further, the CPU 61 can control the transport mechanism 40 (refer to FIG. 1) and the drive mechanism 98 (refer to FIG. 2) based on the embroidery data 80. Thus, the string-like material 18 can be sewn onto the work cloth 100.

When the rotation member 93 is rotated based on the embroidery data 80, the CPU 61 controls the drive mechanism 98 such that the rotation member 93 is rotated at step S28 (refer to FIG. 10) before moving the embroidery frame 9 at step S18 (refer to FIG. 9). By doing this, the string-like material 18 is arranged such that it extends in a direction opposite to the movement direction of the embroidery frame 9. After that, the embroidery frame 9 is moved and the string-like material 18 is sewn (step S18 and step S19). Therefore, the stitches 89 are formed so as to overlap with the string-like material 18 that is arranged such that it extends in the direction opposite to the movement direction of the embroidery frame 9, and the string-like material 18 is sewn onto the work cloth 100 more reliably.

Further, the CPU 61 can rotate the rotation member 93 in the rotation direction determined at step S26 or step S27 based on the embroidery data 80 (step S28). For example, in order to avoid the string-like material 18 from becoming wound around the needle bar 6 or the presser foot 5, it is necessary to set a rotatable range of the rotation member 93. In the present embodiment, the CPU 61 determines the rotation direction such that the rotation member 93 is rotated within the set rotatable range (step S26 and step S27). It is thus possible to reduce a possibility that the string-like material 18 becomes wound around the needle bar 6 or the presser foot 5.

Further, in the present embodiment, when the rotation range is a range in which the first guide portion 932 or the second guide portion 934 comes into contact with the protruding portion 942, namely, when the rotation range is equal to or more than 0 degrees and less than 15 degrees, or more than 340 degrees and less than 360 degrees (no at step S21), the rotation angle R is corrected such that it does not fall within the range of 0 degrees≤R<15 degrees and the range of 340 degrees<R<360 degrees (step S22). Therefore, even when the rotation angle in the embroidery data 80 is set to a rotation angle at which the protruding portion 942 is located, it is possible to arrange the first guide portion 932 and the second guide portion 934 while avoiding the protruding portion 942.

Figure 15:
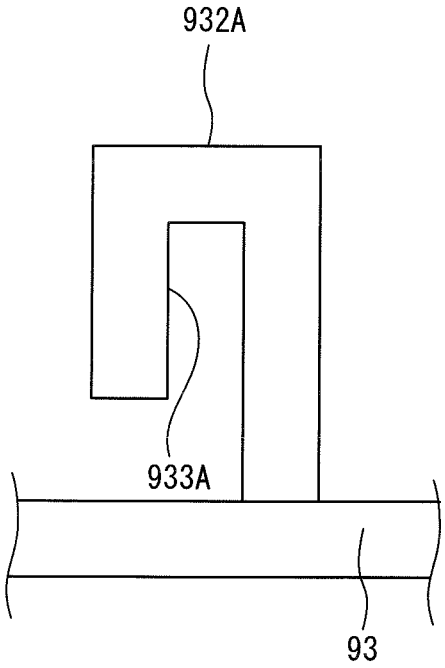
FIG. 15 is a view showing a modified example of a first guide portion.

Note that the present disclosure is not limited to the above-described embodiment and various modifications are possible. For example, although the first through hole 933 of the first guide portion 932 is a hole, it need not necessarily be a hole as long as it is a penetrating portion that can guide the string-like material 18. For example, as shown by a first guide portion 932A in FIG. 15 that is a modified example of the first guide portion 932, the whole of the first guide portion 932A may be formed in a hook shape. The up-down direction and the left-right direction of FIG. 15 respectively correspond to the up-down direction and the circumference direction of the rotation member 93. In the example shown in FIG. 15, the inside of the hook is a first penetrating portion 933A that penetrates the first guide portion 932A. Similarly, the second through hole 937 of the second guide portion 934 need not necessarily be a hole, and may be a penetrating portion that penetrates the second guide portion 934.

Further, although the first through hole 933 extends to the inside in the radial direction of the rotation member 93, it may extend in another direction. Although the second through hole 937 extends in the up-down direction, it may extend in another direction. Further, the second guide portion 934 need not necessarily be provided.

The embroidery frame 9 clamps and holds the work cloth 100 such that the outer peripheral side surface of the frame portion 921 is fitted into the inside of the frame portion 911. However, it is sufficient if the embroidery frame 9 is configured to hold the work cloth 100, and another configuration may be used to hold the work cloth 100. For example, a slit to clamp the work cloth 100 may be provided in the bottom surface of a frame portion of the embroidery frame 9, and the work cloth 100 may be held by the slit. Further, the protruding portion 942 need not necessarily be provided.

Further, although the embroidery data 80 is stored in the ROM 62, it may be stored in an external storage device of the sewing machine 1. In this case, the CPU 61 may acquire the embroidery data 80 from the external storage device at step S11.

Further, although the rotation direction is determined at step S26 and step S27, the rotation direction need not necessarily be determined and the rotation member 93 may always be rotated clockwise. Further, when the CPU 61 rotates the rotation member 93 based on the embroidery data 80, the CPU 61 controls the drive mechanism 98 such that the rotation member 93 is rotated at step S28 (refer to FIG. 10) before moving the embroidery frame 9 at step S18 (refer to FIG. 9). However, the CPU 61 may rotate the rotation member 93 after moving the embroidery frame 9. Further, the CPU 61 may simultaneously perform an operation to move the embroidery frame 9 and an operation to rotate the rotation member 93.

What is claimed is:

1. An embroidery frame comprising:

a mounting portion that is capable of being mounted on a carriage of a transport device of a sewing machine;

an annular portion that is formed in an annular shape and that is configured to hold a work cloth;

a rotation member that is formed in an annular shape and that is supported by the annular portion, the rotation member being capable of rotating in a circumference direction of the annular portion;

a first guide portion that is provided on the rotation member and that has a first penetrating portion in which a through hole is formed and through which a string-like material to be supplied for sewing is inserted;

an extending portion that is formed on the annular portion and that extends toward the outside in a radial direction of the annular portion; and a drive mechanism that is provided on the extending portion and that rotates the rotation member.

2. The embroidery frame according to claim 1, wherein a direction of penetration of the first penetrating portion penetrates is along a radial direction of the rotation member.

3. The embroidery frame according to claim 2, further comprising:

a second guide portion that has a second penetrating portion that is provided on the rotation member, wherein the second penetrating portion is open along a rotation axis direction of the rotation member, and is provided on an upstream side of the first penetrating portion on a feed path of the string-like material, the string-like material to be supplied for sewing being inserted through the second penetrating portion.

4. The embroidery frame according to claim 3, wherein the first penetrating portion and the second penetrating portion are holes.

5. The embroidery frame according to claim 1, wherein the rotation member includes a first gear on an outer peripheral side surface of the rotation member, and the rotation mechanism includes a second gear that meshes with the first gear, and a motor that drives the second gear.

6. The embroidery frame according to claim 1, wherein the annular portion includes a first annular portion having an annular shape, and a second annular portion having an annular shape, which is configured such that an outer peripheral side surface of the first annular portion is fitted into the inside of the second annular portion.

7. A sewing machine comprising:

a transport device that moves an embroidery frame mounted thereon, the embroidery frame including a mounting portion that is capable of being mounted on a carriage of the transport device of the sewing machine, an annular portion that is formed in an annular shape and that is configured to hold a work cloth, a rotation member that is formed in an annular shape and that is supported by the annular portion, the rotation member being capable of rotating in a circumference direction of the annular portion, a first guide portion that is provided on the rotation member and that has a first penetrating portion in which a through hole is formed and through which a string-like material to be supplied for sewing is inserted, an extending portion that is formed on the annular portion and that extends toward the outside in a radial direction of the annular portion, and a drive mechanism that is provided on the extending portion and that rotates the rotation member;

a memory that stores sewing data to sew the string-like material, the sewing data including movement data that causes the embroidery frame to move for each stitch, and rotation data that causes the rotation member to rotate; and a control device that acquires the sewing data, and that controls the transport device and the drive mechanism based on the acquired sewing data.

8. The sewing machine according to claim 7, wherein when the rotation member is rotated based on the sewing data, the control device controls the drive mechanism such that the rotation member is rotated before the embroidery frame is moved.

9. The sewing machine according to claim 7, wherein the control device determines a rotation direction of the rotation member based on the sewing data, and the control device controls the drive mechanism such that the rotation member is rotated in the determined rotation direction.

* * * * *